United States Patent [19]

Cerroni

[11] 4,148,719

[45] Apr. 10, 1979

[54] METHOD FOR SEPARATING URBAN WASTE MATERIALS

[76] Inventor: Manlio Cerroni, Via Bruxelles 53, Rome, Italy

[21] Appl. No.: 830,707

[22] Filed: Sep. 6, 1977

Related U.S. Application Data

[63] Continuation of Ser. No. 674,075, Apr. 6, 1976, abandoned.

[30] Foreign Application Priority Data

Apr. 16, 1975 [IT] Italy ..... 49146 A/75

[51] Int. Cl.[2] ..... B07B 4/02

[52] U.S. Cl. ..... 209/139 R; 209/147

[58] Field of Search ..... 209/34–37, 209/26–29, 136–139 R, 140, 141, 147, 149, 154

[56] References Cited

U.S. PATENT DOCUMENTS

| | | | |
|---|---|---|---|
| 202,122 | 4/1878 | Roberts | 209/37 |
| 1,188,323 | 6/1916 | Richardson | 209/138 X |
| 1,854,209 | 4/1932 | McLean | 209/147 X |
| 1,861,248 | 5/1932 | Stebbins | 209/37 X |
| 3,306,018 | 2/1967 | Whitman | 209/138 X |
| 3,311,234 | 3/1967 | Rumpf et al. | 209/139 R X |
| 3,312,343 | 4/1967 | Elder et al. | 209/147 X |
| 3,655,043 | 4/1972 | Wochnowski et al. | 209/138 |
| 3,836,085 | 9/1974 | Brown | 241/19 |
| 3,907,670 | 9/1975 | Fernandes | 209/149 X |
| 4,010,096 | 3/1977 | Murray et al. | 209/139 R |

*Primary Examiner*—Ralph J. Hill

*Attorney, Agent, or Firm*—Toren, McGeady and Stanger

[57] ABSTRACT

Apparatus for separating urban waste materials is formed with a vertically extending duct having a waste material inlet and a suction device at the upper end of said duct with a slanted wall being provided opposite the material inlet to deflect downwardly into the duct certain portions of the waste material caused to impinge against the slanted wall. The duct inlet is formed to enable ambient air to enter the duct through the interstice of the inlet in order to impart an accelerating force to the incoming material.

1 Claim, 1 Drawing Figure

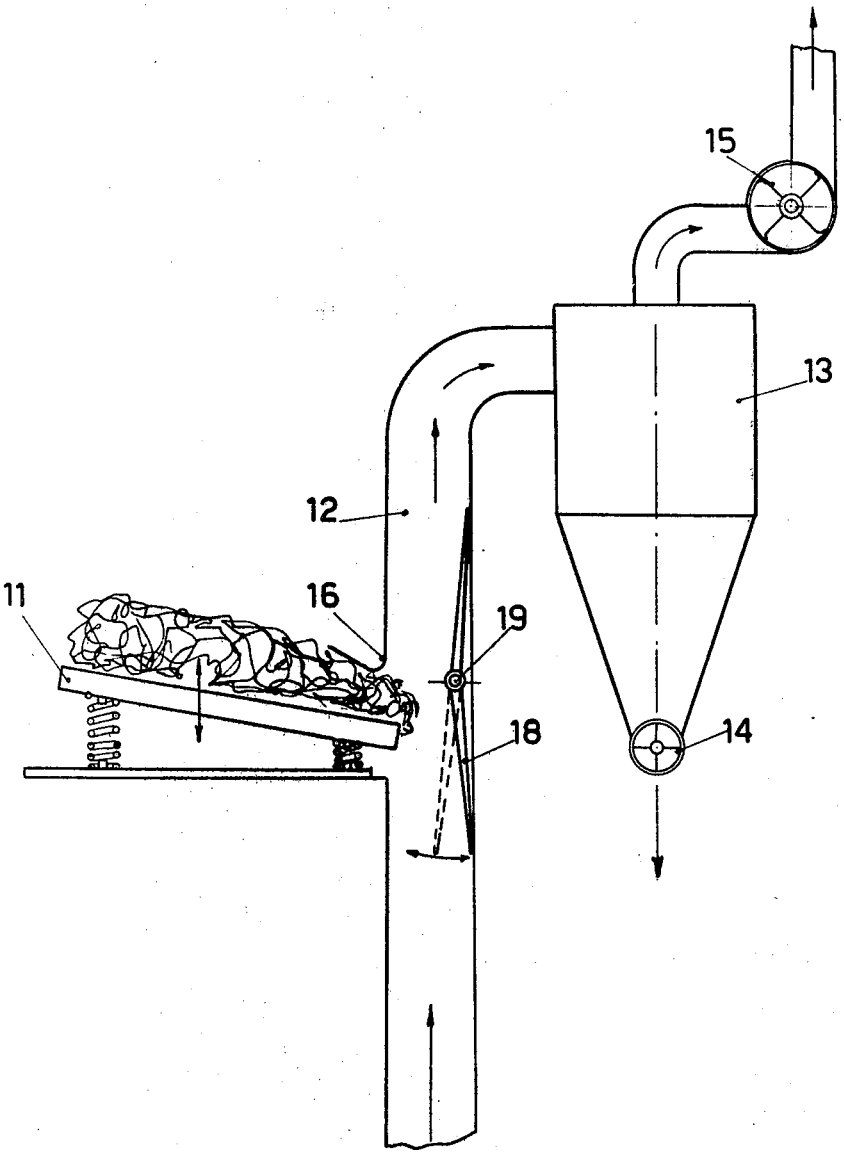
15
13
12
11
16
19
18
14

METHOD FOR SEPARATING URBAN WASTE MATERIALS

This is a continuation of application Ser. No. 674,075 filed Apr. 6, 1976 now abandoned.

BACKGROUND OF THE INVENTION

The present invention relates generally to waste treatment apparatus and more particularly to a device for separating components of such waste materials.

It is known that to classify materials that are heterogenous as to their shape and weight, very frequently, air classifiers are utilized. However, these classifiers are effective only in the case where there is present a substantial uniformity, at least in the size of the material. Conventional classifiers operate mainly, if not exclusively, by utilization of a rising air stream, which creates within the duct in which flows, a different buoyancy of the materials based upon their specific weight.

In the case of urban solid wastes, uniform component size is rare, but very frequently a nearly uniform component weight exists.

It is an object of the present invention to provide a process for the classification of heterogenous materials and more particularly urban solid wastes. The process is such as to obtain efficient separation of the solid wastes.

Another object of the present invention is the provision of apparatus for performance of the aforementioned process.

SUMMARY OF THE INVENTION

The classification process, according to the present invention, is accomplished by on the use of a primary air stream and a secondary air-stream, both flowing in the same duct as the result of a vacuum or pressure reduction. The secondary air-stream entrains the products or the material that are brought in the duct under vacuum, accelerating said materials.

On the basis of this process, and in connection with the different weights and volumes of the materials, the acceleration of the materials is accomplished in different ways and according to different characteristics of the different materials, in such a way that whereas some materials are lifted within the duct under vacuum, others fall. Indeed, the fall of these materials is helped by their impact against the surface of wall means within the duct, that is suitably slanted, in such a way as to give a component downwardly to the impinging material.

The invention also includes apparatus for performing the classification process including feeder means, preferably a shaking or vibrating conveyor, feeding the material to the duct. This duct is under vacuum through an exhauster, followed by a centrifugal separator provided with a valve having a stellate shape.

An important feature of the apparatus of the present invention, is that the duct under vacuum is provided with a wall, placed opposite to the shaking conveyor, or duct inlet, with the wall being slanted relative to the axis of the duct, in such a way that the accelerated particles hitting the wall are subjected to a thrust downwardly, that is the resultant of the force due to the weight and to the acceleration that the particle has received by the stream of the secondary air.

DESCRIPTION OF THE DRAWING

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

The single FIGURE of drawing is a schematic representation of the apparatus of the invention.

DETAILED DESCRIPTION OF THE PREFERRED EMBODIMENT

With reference to the drawing, the material coming from a primary separator and of course already selected—and this to the purpose of obtaining a better output from the plant—is discharged on a shaking or vibrating conveyor 11 and fed thereby to duct 12. The duct 12 leads to a centrifugal separator 13 provided with stellate valve 14, or to a suitable exhauster 15

As seen in the drawing, the air classifier according to the invention, is subjected to air suction by the exhauster 15 which draws air from the bottom of the duct 12 customary classifiers and through an upper surface 16 of the material inlet. Indeed, an important characteristic of the apparatus of the present invention is that the charging mouth or inlet, through which the material is introduced into the duct 12, is not tight. In other words, and in opposition to what occurs in the customary classifiers, a certain amount of secondary air is permitted to be drawn into the duct which is under vacuum, through the material to be classified and the upper edge 16 of the inlet mouth.

The air coming in through the interstice, also if reduced to a minimum is present in a very small amount and has the purpose of accelerating the particles that the shaking conveyor is feeding to the duct 12 under vacuum.

As will be seen from the drawing, the duct 12 has wall means 18 located opposite to the material inlet and, conveniently slanted relative to the vertical. The slant of the wall 18 must be such that the material coming in, under the vacuum in the duct 12, fed by the feeder 11 and accelerated by the secondary air, it has suitable weight and shape characteristics, hits the wall 18 in such a way that the resultant of the forces acting on the material leads the material to fall downwards, whereas the material, that according its characteristics, has insufficient weight and is not sufficiently accelerated, undergoes the effect of the air suction and therefore reaches the centrifugal separator 13. From the centrifugal separator 13 the material goes through a stellate valve 14, and the paper and the plastic films within the waste material under treatment will be separated, whereas the other materials are separated using other means.

The slanted wall 18 has a predominant function, together with the secondary air, to effect classification of the material. Since the material can be of different qualities, and be different insofar as its amount and weight are concerned, the wall 18 can be suitably hinged or pivoted at 19 in such a way that it can change its slant relative to the axis on the duct 12.

In the operation of the present invention the feeder 11, preferably a shaking vibrating conveyor, distributes the received material, feeding it to the duct 12. As a consequence of the air suction or reduced pressure within duct 12 and of the interstice between the upper 16 of the inlet mouth of the material, or the feeding plane of the feeder 11, the material, at its inlet in the duct 12, is subjected to an acceleration as a result of ambient air flowing in through the interstice of the inlet. Some material will strike the wall 18 and, as a result, it will have a downwardly directed force imparted thereto. Heavier material will not strike the wall 18, but will merely drop down into the duct 12. Lighter material will be drawn upwardly through the duct 12 into the centrifugal separator 13.

It is evident that with a process such as the one just described and using the apparatus shown, it is possible, using as starting material, materials which are extremely heterogenous, such as urban solid wastes, it is possible to obtain a separation of the different materials in connection with their weight and their shape-coefficient, allowing in such a way a different use of the materials representing the incoming mass.

While a specific embodiment of the invention has been shown and described in detail to illustrate the application of the inventive principles, it will be understood that the invention may be embodied otherwise without departing from such principles.

I claim:

1. A method for separating waste materials, particularly urban solid wastes, comprising the steps of:

introducing said waste material into a generally airtight vertically extending duct through a waste material inlet intermediate the upper and lower ends of said duct;

producing a vacuum within said duct from a point above said waste material inlet with a level of vacuum sufficient to cause ambient atmosphere surrounding said duct to flow through said waste material inlet together with said waste material and to entrain said waste material thereby to impart to said entrained waste material a horizontal force sufficient to propel said entrained waste material across said duct and into impingement against a downwardly slanted wall located within said duct directly opposite said waste material inlet;

selecting for said downwardly slanted wall a specific predetermined angle relative to the vertical, said angle being established in accordance with a degree of downward component force to be imparted to said impinging waste material to thereby determine, depending upon said degree of downward component force, portions of said waste material which are to be actively propelled upwardly and downwardly relative to said waste material inlet within said duct; and locating said downwardly slanted wall means within said duct across from said waste material inlet at said specific predetermined angle thereby to selectively control the separation of said incoming waste material.

* * * * *